US011668064B2

(12) United States Patent
Waltz et al.

(10) Patent No.: US 11,668,064 B2
(45) Date of Patent: Jun. 6, 2023

(54) COUPLER FOR HELICAL PILE AND TIEBACK SUPPORT SYSTEMS

(71) Applicant: Supportworks, Inc., Papillion, NE (US)

(72) Inventors: John E. Waltz, Papillion, NE (US); Kyle L. Olson, Papillion, NE (US)

(73) Assignee: SUPPORTWORKS, INC., Papillion, NE (US)

( * ) Notice: Subject to any disclaimer, the term of this patent is extended or adjusted under 35 U.S.C. 154(b) by 0 days.

(21) Appl. No.: 17/494,232

(22) Filed: Oct. 5, 2021

(65) Prior Publication Data

US 2022/0106758 A1 Apr. 7, 2022

Related U.S. Application Data

(60) Provisional application No. 63/088,023, filed on Oct. 6, 2020.

(51) Int. Cl.
*E02D 5/56* (2006.01)
*E02D 5/52* (2006.01)

(52) U.S. Cl.
CPC ..... *E02D 5/526* (2013.01); *E02D 5/56* (2013.01); *E02D 2600/20* (2013.01)

(58) Field of Classification Search
CPC ..... E02D 5/526; E02D 5/56; E02D 2600/20; E02D 5/523; F16D 1/02; F16D 1/027; Y10T 403/5733; Y10T 403/5741
See application file for complete search history.

(56) References Cited

U.S. PATENT DOCUMENTS

| | | | | |
|---|---|---|---|---|
| 7,037,045 | B2 | 5/2006 | Jones | |
| 10,006,185 | B2 | 6/2018 | Tomchesson et al. | |
| 2003/0159839 | A1* | 8/2003 | Perko | E02D 27/50 172/100 |
| 2011/0194901 | A1 | 8/2011 | Jones | |
| 2016/0145824 | A1* | 5/2016 | Lutenegger | E02D 5/801 405/252.1 |
| 2016/0186402 | A1* | 6/2016 | Tomchesson | E02D 27/12 405/252.1 |
| 2017/0183839 | A1* | 6/2017 | Reusing | E02D 35/005 |
| 2017/0198453 | A1 | 7/2017 | Brown et al. | |
| 2019/0271131 | A1* | 9/2019 | Perko | E02D 5/56 |

OTHER PUBLICATIONS

Blessen, Jake et al., Supportworks Technical Manual (3rd Edition), Mar. 2019, 364 pages.

* cited by examiner

*Primary Examiner* — Sean D Andrish
(74) *Attorney, Agent, or Firm* — Suiter Swantz pc llo

(57) ABSTRACT

A coupler for a helical pile system is described. The coupler includes at least two sections of square tube. A first section is nested within and affixed to the second section. The first section may further include an inner width by which the first section is configured to receive two pieces of rectangular bar stocks of a helical pile system. The at least two sections each include at least two pairs of aligned through holes, for receiving first and second bolts. By the first bolt and second bolts, the two pieces of rectangular bar stock may be coupled. The first section may thus transfer torsion between the two pieces of rectangular bar stock, such as when screwing the helical pile system into the earth.

15 Claims, 16 Drawing Sheets

100

100

COUPLER FOR HELICAL PILE AND TIEBACK SUPPORT SYSTEMS

CROSS-REFERENCE TO RELATED APPLICATION

The present application claims the benefit under 35 U.S.C. Section 119(e) of U.S. Provisional Application No. 63/088,023, filed, Oct. 6, 2020, naming John E. Waltz and Kyle L. Olson, titled COUPLER FOR HELICAL PILE AND TIEBACK SUPPORT SYSTEMS, which is incorporated herein by reference in the entirety.

TECHNICAL FIELD

The present invention generally relates to foundation systems, and more particularly to a coupler for helical piles.

BACKGROUND

Retaining walls and building walls, such as foundation walls below grade, are subjected to unbalanced earth pressures, pressures from swelling soil or frost, hydrostatic pressures, surcharge loads, and other forces that effectively act to push laterally on these walls. Vertical compression and uplift forces on a structure may also be generated from the weight of building materials, contents and people, environmental forces (wind, snow, earthquakes, etc.), high or fluctuating groundwater levels, surrounding soil loads, and other factors. A method to address such foundation issues is to implement a support system including one or more helical piles or helical tiebacks. For example, piles may penetrate weak near-surface soil and extend to a deeper, more competent bearing layer. Helical piles then effectively transfer the vertical loads of the structure from the foundation to these deeper soils. For the lateral loads on a retaining wall or foundation wall, helical tiebacks are installed similarly to helical piles but in a horizontal or near-horizontal orientation to resist the loads axially, or along the shaft length, as opposed to transverse to the shaft.

In some implementations, the helical pile may include a shaft made of multiple pieces of square bar stock. The pieces of square bar stock are fabricated with a given corner radius, typically caused by a rolling process. The pieces of square bar stock may be joined by a coupler, such as a forged upset coupler, to create a socketed connection. However, such forging processes may be relatively time consuming, costly, and require customized forging equipment.

Therefore, it would be advantageous to provide one or more of a device, system, or method that cures the shortcomings described above.

SUMMARY

Embodiments of the present disclosure are directed to a coupler. In one embodiment, the coupler includes a first square tube including a first wall defining a first interior recess, a first pair of through holes, and a second pair of through holes. The first interior recess extends through the first square tube. The first interior recess is of a first inner width for receiving a square bar stock of a helical pile system. In another embodiment, the coupler includes a second square tube including a second wall defining a second interior recess, a third pair of through holes, and a fourth pair of through holes. The second interior recess extends through the second square tube. The second interior recess is of a second inner width for receiving the first square tube. The first square tube is received within the second interior recess and is affixed to the second square tube by a permanent joint. The first pair of through holes and the third pair of through holes are aligned for receiving a first bolt. The second pair of through holes and the fourth pair of through holes are aligned for receiving a second bolt. In this regard, the coupler may include nested square tubing for providing a desired fitment and torsional capacity.

Embodiments of the present disclosure are also directed to a helical pile system. In one embodiment, the helical pile system includes a lead section including a first square bar stock and a plurality of helix plates affixed to the first square bar stock. In another embodiment, the helical pile system includes an extension section including a second square bar stock. In another embodiment, the helical pile system includes a coupler. The coupler includes a first square tube including a first wall defining a first interior recess, a first pair of through holes, and a second pair of through holes. The first interior recess extends through the first square tube. The first interior recess is of a first inner width for receiving the first square bar stock and the second square bar stock. The coupler also includes a second square tube including a second wall defining a second interior recess, a third pair of through holes, and a fourth pair of through holes. The second interior recess extends through the second square tube. The second interior recess is of a second inner width for receiving the first square tube. The first square tube is received within the second interior recess and is affixed to the second square tube by a permanent joint. The first pair of through holes and the third pair of through holes are aligned for receiving a first bolt. The second pair of through holes and the fourth pair of through holes are aligned for receiving a second bolt. The first square bar stock defines a first through hole. The first bar stock is received within a first portion of the first interior recess and is coupled to the coupler by the first bolt, the first pair of through holes, the third pair of through holes, and the first through hole. The second square bar stock defines a second through hole. The second bar stock is received within a second portion of the first interior recess and is coupled to the coupler by the second bolt, the second pair of through holes, the fourth pair of through holes, and the second through hole.

Embodiments of the present disclosure are also directed to an extension section for a helical pile system. In one embodiment, the extension section includes a square bar stock. In another embodiment, the extension system includes a coupler. The coupler includes a first square tube including a first wall defining a first interior recess and a first pair of through holes. The first interior recess extends through the first square tube. The first interior recess is of a first inner width for receiving the square bar stock. The coupler also includes a second square tube including a second wall defining a second interior recess and a second pair of through holes. The second interior recess extends through the second square tube. The second interior recess is of a second inner width for receiving the first square tube. The first square tube is received within the second interior recess and affixed to the second square tube by a permanent joint. The first pair of through holes and the second pair of through holes are aligned for receiving a bolt. The square bar stock is received within a first portion of the first interior recess. The first square tube is affixed to the second square tube by a second permanent joint. A second portion of the interior recess aligned with the first pair of through holes and the second pair of through holes, by which the coupler is configured to receive and couple to a second square bar stock.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1A:
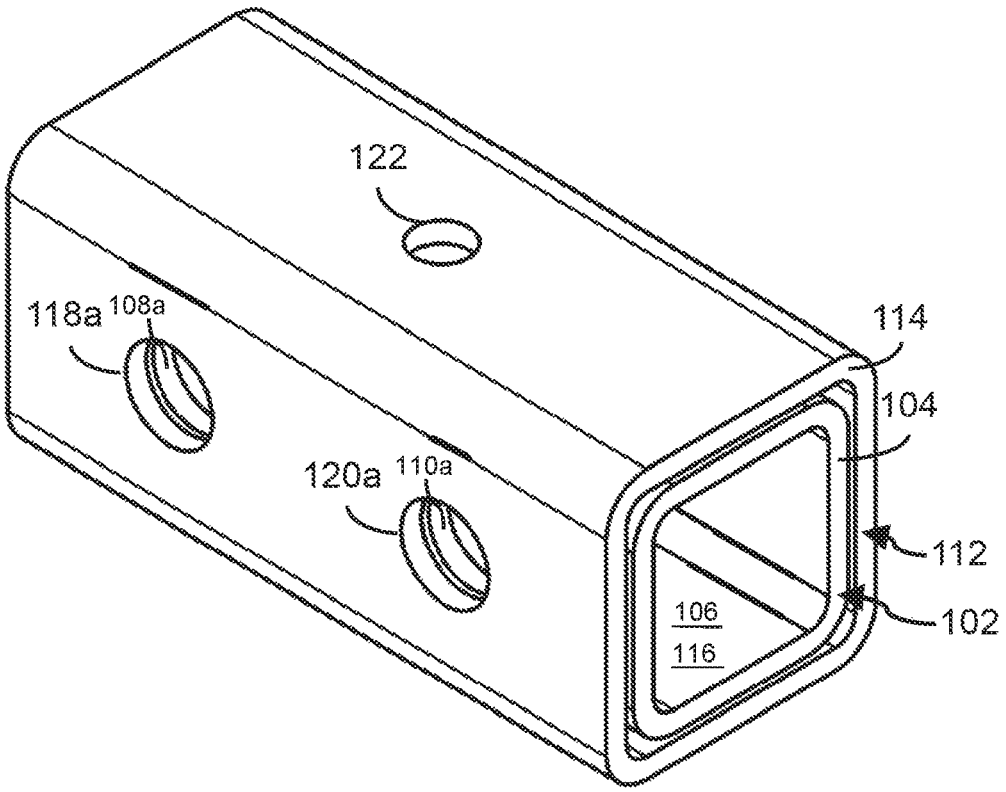
FIG. 1A illustrates a perspective view of a coupler, in accordance with one or more embodiments of the present disclosure.
Figure 1B:
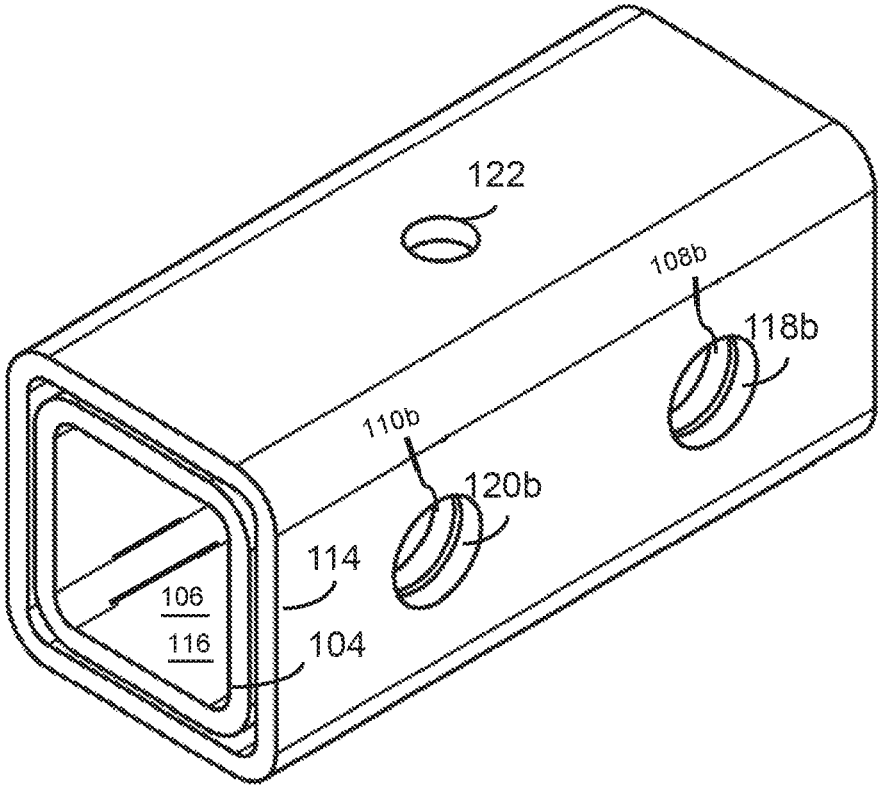
FIG. 1B illustrates a perspective view of a coupler, in accordance with one or more embodiments of the present disclosure.
Figure 1C:
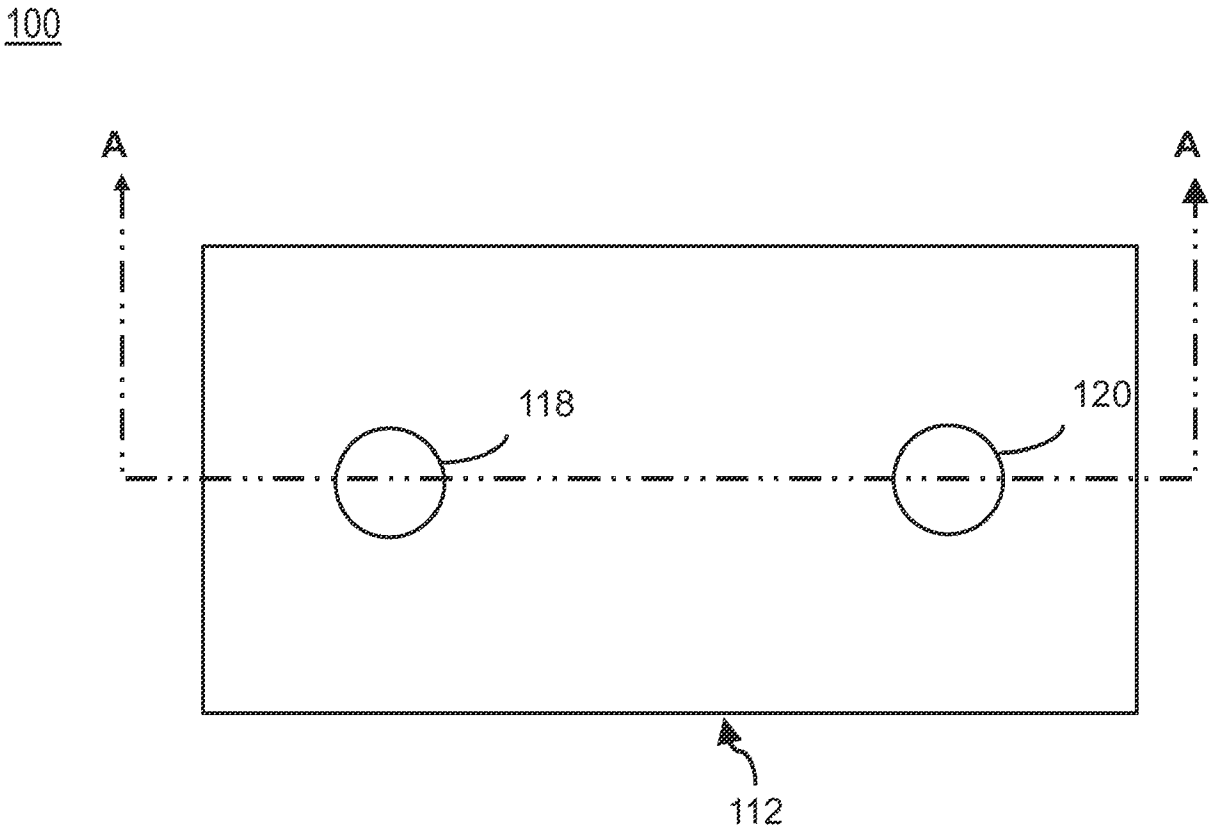
FIG. 1C illustrates a side-plan view of a coupler, in accordance with one or more embodiments of the present disclosure.
Figure 1D:
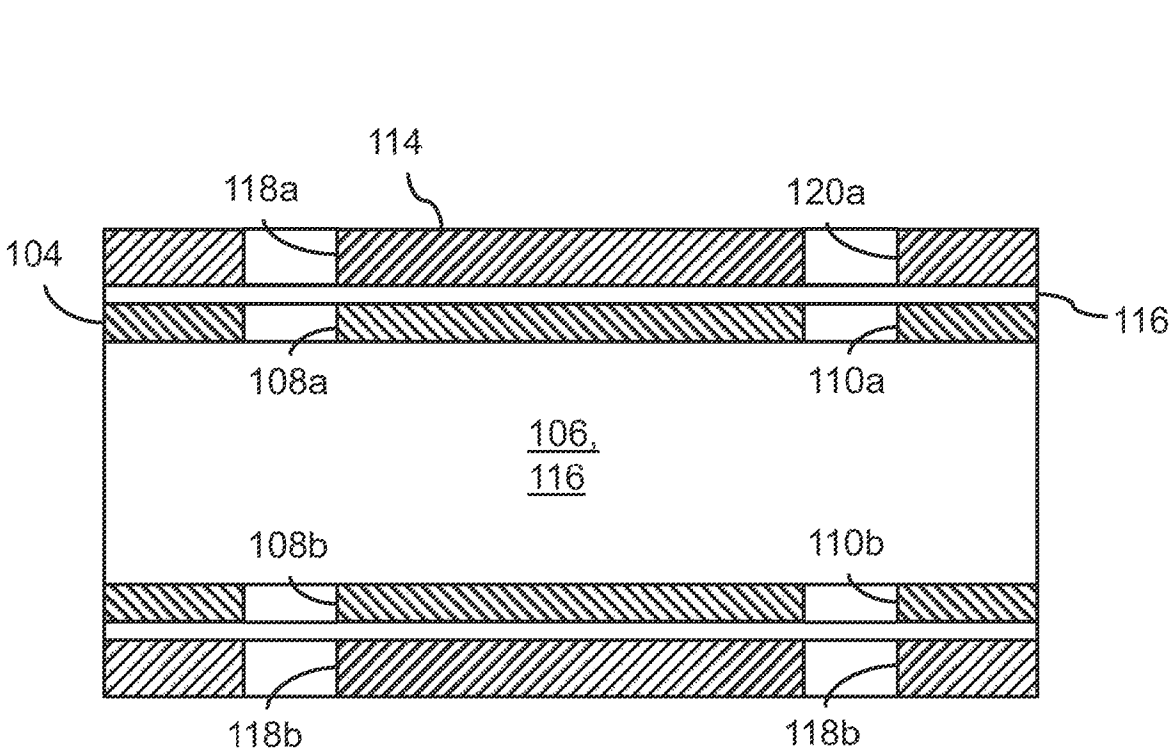
FIG. 1D illustrates a cross-section view A of the coupler of FIG. 1C, in accordance with one or more embodiments of the present disclosure.
Figure 1E:
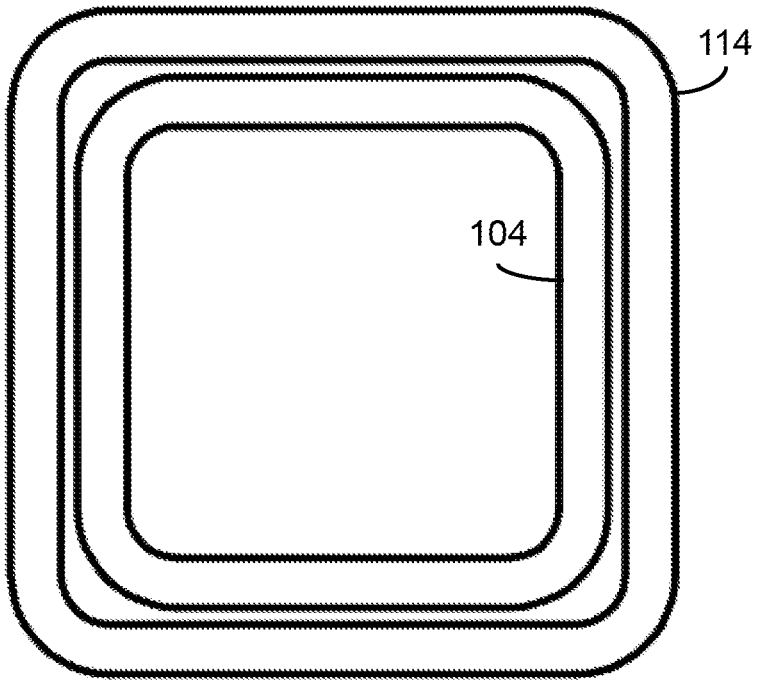
FIG. 1E illustrates a top-plan view of a coupler, in accordance with one or more embodiments of the present disclosure.
Figure 1F:
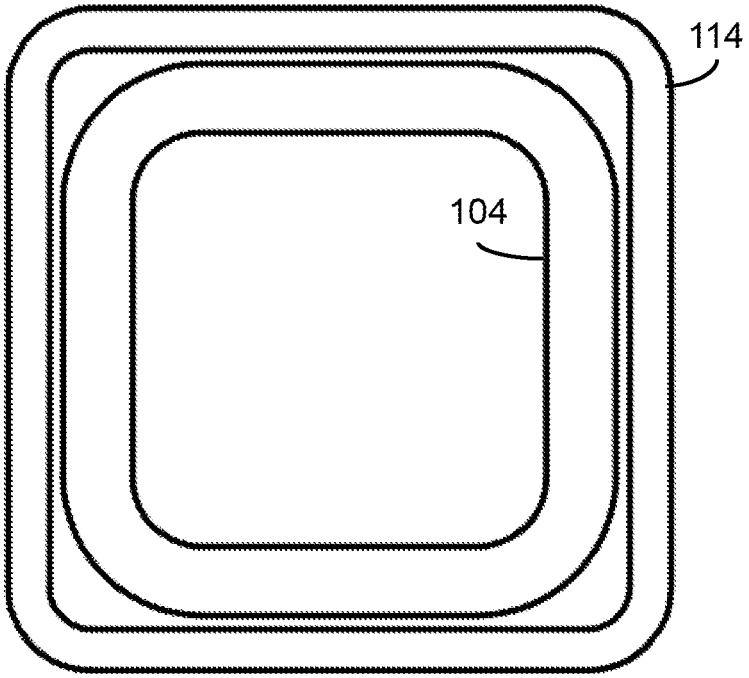
FIG. 1F illustrates a top-plan view of a coupler, in accordance with one or more embodiments of the present disclosure.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive "or". For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination or sub-combination of two or more such features, along with any other features which may not necessarily be expressly described or inherently present in the instant disclosure.

Square tubing may be used to couple pieces of square bar stock. Such square tubing must balance proper geometry for fitment around the square bar stock with meeting torsional requirements. In particular, square tubing may include weld seams which extend inward and reduce the effective inside diameter. Square tubing may also include corner radii. The thickness of the tubing may be proportional to both a corner radius and a torsional capacity. To meet desired torsional capacities, thicker walled square tubing may be required. However, such thicker walled tubing also causes larger radii, and thus a lack of fitment due to interference between the corners of the square tubing and the corners of the square bar stock. Thus, the square tubing may need to be modified to meet both the fitment and torsional capacity requirements.

Additionally, square tubing could increase the outside dimensions to allow thicker square tubing and increased clearance for corner radii. However, increased clearance dimensions between the square tubing and square bar stock pose many issues including but not limited to misalignment of the concentric axial loads. Tight clearance dimensions between members is typically desired to provide a desired level of fitment.

Embodiments of the concepts disclosed herein are directed generally to a coupler 100 and a helical pile system 600 including the coupler 100. The coupler 100 may include two or more square tubes. A first of the square tubes may be received within and affixed to a second of the square tubes. The first square tube may also be configured to receive and be affixed to two pieces of square bar stock of the helical pile system 600 (e.g., an extension and a lead section; two extensions, etc.). In this regard, the coupler 100 may couple the two pieces of square bar stock. The coupler 100 may further provide such a coupling while meeting a conventional torsional capacity requirement of square pile couplers without requiring an upset forged end. The ability to use a standard gauge square tubing while meeting a select torsional capacity without requiring an upset end may be advantageous in providing reduced manufacturing requirements. In some embodiments, the coupler 100 may also be detachable from both pieces of square bar stock (e.g., a detached coupler), such that the coupler is not integrated into the extension or the lead section. This use of detached couplers may allow for re-use of leftover square tubing material, among other manufacturing benefits. Furthermore, a number of detached couplers may be provided with different torsional capacities with such detached coupler selected based on the soil type and quality, among other assembly benefits. Embodiments of the present disclosure are also directed to an extension 300. The extension 300 may include a square bar stock welded to a coupler similar to the coupler 100.

Referring now to FIG. 1A-1F a coupler 100 is described, in accordance with one or more embodiments of the present disclosure. The coupler may include a square tube 102 and a square tube 112. The square tube 102 may be received within and affixed to the square tube 112. The square tube 102 may provide a desired fitment with square bar stock of a helical pile. Furthermore, the square tube 112 may increase a torsional capacity of the square tube 102.

The square tube 102 may include a wall 104. The wall 104 may include four faces of substantially similar length. The wall 104 may be bounded by an outside width. Similarly, the square tube 112 may include a wall 114. The wall 114 may include four faces of substantially similar length. The wall 114 may be bounded by an outside width. Generally, the outside width of the wall 104 may be less than the outside width of the wall 114. The outside width of the walls 104, 114 may include, but is not limited to, between 1.5 inches and 5 inches. The walls 104, 114 may also include a thickness, such as, but not limited to, between 0.06 inches to 0.5625 inches. As may be understood, the outside width and wall thickness are a means by which square tubing may be identified. The square tubes 102, 112 may also each include four corners with a radius. The radius may be based on the wall thickness. Thus, as the square tubing thickness increases the corner radii may also increase. For example, the square tubing may include a corner radius between 0.13 inches and 0.36 inches, or more. Such corner radius may be based on the manufacturing process by which the square tubes 102, 104 are produced.

The walls 104, 114 may also define one or more components of the square tubes. The wall 104 may define an interior recess 106. Similarly, the wall may define an interior recess 116. The interior recesses 106, 116 may extend through the associated square tube. As may be understood, the interior recesses 106, 116 may be formed during the forming process of the standard gauge square tubing. The interior recesses 106, 116 may include a substantially square inner cross-section. The substantially square inner cross-section may be bounded by the walls 104, 114. The inner cross-section may be substantially square in that the inner cross-section may include a radius in the corners, based on the radius of one or more of the corners of the walls 104, 114. The walls 104, 114 may further include an inner width (i.e., an inner width of the inner width of the interior recesses 106, 116). The inner width may be based on the outside width and the wall thickness of the associated tube. In some embodiments, the inner width of the wall 104 is such that the interior recess 106 may receive a square bar stock (e.g., square bar stock of helical bar assembly 600). The square bar stock may be received by a clearance fit, such that the inner width is greater than a width of the square bar stock. The outer width and the wall thickness of the wall 104 may also be selected such that the square tube 102 is configured to receive the square bar stock without interference between the corners of the square tube 102 and the corners of the square bar stock. Similarly, the inner width of the wall 114 may be such that the interior recess 116 may receive the square tube 102. The square tube 102 may be received by a clearance fit, such that the inner width of the wall 114 is greater than the outer width of the wall 104. The outer width and the wall thickness of the square tube 112 may further be selected such that the interior recess 116 receives the square tube 102 without interference between the corners of the square tube 112 and the corners of the square tube 102.

By receiving the square tube 102 within the inner recess 116, the total outside dimensions of the coupler 100 may be increased. Such increase in dimensions may cause the coupler 100 to achieve a desired torque capacity. In particular, the coupler 100 may meet a select torsional capacity which is greater than conventional torsional capacity requirements of square pile couplers by the square tubes 102, 104. Such conventional torsional capacity requirements may be based, at least in part, on ICC Evaluation Service standards. Furthermore, the desired torsional capacity may be achieved without an upset forging process. Additionally, the coupler 100 may include a torsional capacity which is greater than the individual torsional capacities of the square tubes 102, 104.

Various examples of coupler widths and thicknesses, together with an associated torque capacity are not described. In a first example, where the square bar stock is 1.5 inches thick with corner radii of 0.25 inches, the square tube 102 may include an outer width of 2 inches and a wall thickness of 0.1875 inches, and the square tube 112 may include an outer width of 2.5 inches and a wall thickness of 0.1875 inches (see FIG. 1E). For this example, the coupler may meet or exceed a torsional capacity of 6,500 foot-pounds of torque. In a second example, where the square bar stock is 1.75 inches thick with corner radii of 0.25 inches, the square tube 102 may include an outer width of 2.5 inches and a wall thickness of 0.313 inches, and the square tube 112 may include an outer width of 3 inches and a wall thickness of 0.1875 inches (see FIG. 1F). For this example, the coupler may meet or exceed a torsional capacity of 10,000 foot-pounds of torque. As may be understood, the examples provided above are not intended to be limiting. In this regard, a number of square bar stock widths and radii may be provided for use in helical pile systems, such as, but not limited to, 1 inch, 1.25 inches, 1.5 inches, 1.75 inches, or 2 inches. It is contemplated that a number of permutations of square tubes 102, 112 with a select outer width and a select wall thickness may provide a desired fitment and torsional capacity based on the selected square bar stock width and radii.

As depicted, the length of the square tubes 102, 112 may be substantially similar. The ends of the square tubes 102, 112 may further be aligned. The length may increase the stiffness by acting as a sleeve, thereby resisting bending forces. For example, the length of the coupler 100 may be between six and nine inches, or more. About half of such length may extend for receiving a first square bar stock (e.g., a lead, an extension) and about half of such length may extend for receiving a second square bar stock (e.g., the extension, a second extension). It is further contemplated, that although the length of the square tubes 102, 112 are described as being similar and the ends of the square tubes 102, 112 are described as being aligned, this is not intended as a limitation on the present disclosure.

The square tubes 102, 112 may be rolled or formed by another suitable fabrication process. In some embodiments, the square tubes 102, 112 may each be formed from a standard gauge square tubing. The standard gauge square tubing may be in compliance with any square tubing standard known in the art, such as, but not limited to ASTM (American Society for Testing and Materials) A500: Cold-Formed Welded and Seamless Carbon Steel Structural Tubing in Rounds and Shapes, ASTM A501: Hot-Formed Welded and Seamless Carbon Steel Structural Tubing, or ASTM A513: Electric-Resistance-Welded Carbon and Alloy Steel Mechanical Tubing. It is further contemplated that a number of types and grades of such standard gauge tubing may be suitable for the square tubes 102, 112. Thus, the square tubes 102, 112 be made from commonly rolled tubes while meeting a desired fitment and torsional capacity. The coupler may further allow fabrication of square pile shaft couplers without the need for an upset forging process or a custom tube casting. By using such steel tubing, the coupler may be fabricated while accounting for cost and availability concerns. Other types of high strength, rigid materials may be employed as well, including aluminum, carbon fiber, plastics, and composites. The coupler may thus be fabricated by a machine shop without the need for a custom extruder or foundry during the fabrication process. Furthermore, the coupler may be configured to couple with bar stock as an assembly, with such assembly including a high torsional capacity. For example, the coupler may be configured to fit with bar stock without the need for a custom extrusion. Reducing the need for custom extrusions is valuable where the volume of material being extruded does not justify cost expenditures. By way of another example, the coupler may be configured to fit with bar stock without the need for a custom casting. Such reduced need for custom casting provides similar cost savings. Furthermore, the coupler may have improved material properties (e.g., ability to resist deformation, resist impact, resist vibration, compressive strength, tensile strength, etc.) as compared to a more brittle casting.

In some embodiments, the wall 104 may define a pair of through holes 108 (e.g., through hole 108*a*, through hole 108*b*) and a pair of through holes 110 (e.g., through hole 110*a*, through hole 110*b*). The pair of through holes 108, 110 may be disposed on one or more faces of the wall 104. The pair of through holes 108, 110 may be oriented at a given angle relative to the longitudinal span of the square tube 102, such as a transverse or orthogonal angle. The through hole 108*a* and the through hole 108*b* may be disposed on opposite faces of the wall 104. The through hole 110*a* and the through hole 110*b* may be also be disposed on opposite faces of the wall 104. As depicted, the through hole 108*a* and the through hole 110*a* may be disposed on the same face and the through hole 108*b* and the through hole 110*b* may be disposed on the same face, although this is not intended to be limiting.

Similarly, the wall 114 may define a pair of through holes 118 (e.g., through hole 118*a*, through hole 118*b*) and a pair of through holes 120 (e.g., through hole 120*a*, through hole 120*b*). The pair of through holes 108, 110 may be disposed on one or more faces of the wall 114. The pair of through holes 108, 110 may be oriented at an angle relative to the longitudinal span of the square tube 112, such as a transverse or orthogonal angle. The through hole 118*a* and the through hole 118*b* may be disposed on opposite faces of the wall 114. The through hole 120*a* and the through hole 120*b* may be also be disposed on opposite faces of the wall 114. As depicted, the through hole 118*a* and the through hole 120*a* may be disposed on the same face and the through hole 118*b* and the through hole 120*b* may be disposed on the same face, although this is not intended to be limiting.

The pair of through holes 108, 110, 118, 120 may be manufactured by any suitable process, such as, but not limited to, drilling, waterjet cutting, laser cut, or plasma cutting.

In some embodiments, the pair of through holes 108, 110 are selectively positioned on the square tube 102 and the pair of through holes 118, 120 are selectively positioned on the square tube 112, such that the pair of through holes 108 are aligned (e.g., coaxial) with the pair of through holes 118 and the pair of through holes 110 are aligned (e.g., coaxial) with the pair of through holes 120, when the square tube 102 is received within the square tube 112. The square tube 102 and the square tube 112 may then be affixed in such alignment, as described further herein. By the alignment, a first bolt may be received by the pair of through holes 108, 118 and a second bolt may be received by the pair of through holes 110, 120. Such bolts may provide the coupler 100 with a means for coupling one or more square bar stocks of a helical pile. In some embodiments, the diameter of the pair of through holes 108, 110, 118, 120 is selected based upon the bolt diameter. For example, the diameter may be configured to receive a bolt having a width of 0.75 inches. As may be understood, the diameter is not intended to be limiting, and may be increased or decreased as needing based on one or more factors (e.g., a shear strength of said bolts).

The square tube 102 and the square tube 112 may then be affixed when the square tube 102 is received within and aligned relative to the square tube 112. The square tube 112 may be affixed by a permanent joint. The permanent joint may include one or more of a weld (e.g., a lap joint, an edge joint, a spot weld, fillet weld, plug weld etc.), a brazed joint, or other suitable permanent joint. In some embodiments, the weld is a plug weld. The plug weld may be a type of weld where the weld is deposited through a hole of one material and on top of the other material. The hole is filled by the weld, joining the two pieces of metal together. The plug weld may be disposed on or near a midpoint of the square tube 102 and the square tube 112 (see plug weld 122). The midpoint may be a neutral axis in which a stress of the coupler 100 is lowest while loaded in torsion. In this regard, the plug weld may be at a position with minimal stress as compared to a weld at one or more ends of the square tubes. Furthermore, the plug weld may undergo minimal strain, due to a reduced amount of movement at the mid-line. The plug weld may thus join the square tubes 102, 112 for ease of installing the coupler 100 in a helical pile system. A number of such plug welds may be provided at select distances along the span of the square tubes 102, 112 to meet or exceed a desired joint strength. Although the square tubes 102, 112 have been described as being plug welded along a midpoint, this is not intended as a limitation of the present disclosure. For example, the square tubes 102, 112 may be welded by a plug weld at any point on the walls. The presence of any spot-welds, or whether there may be one, two, three, four or more spot-welds is variable and may be dependent on a particular application. By way of another example, the square tubes 102, 112 may be affixed by a non-spot-welding technique, such as, but not limited to, arc or oxyfuel. Such welds may be disposed between one or more edges of the walls. By way of another example, the walls may not be welded together. In this regard, the coupler may be assembled during installation in helical pile system 600 and held together by bolts or pins.

Figure 2:
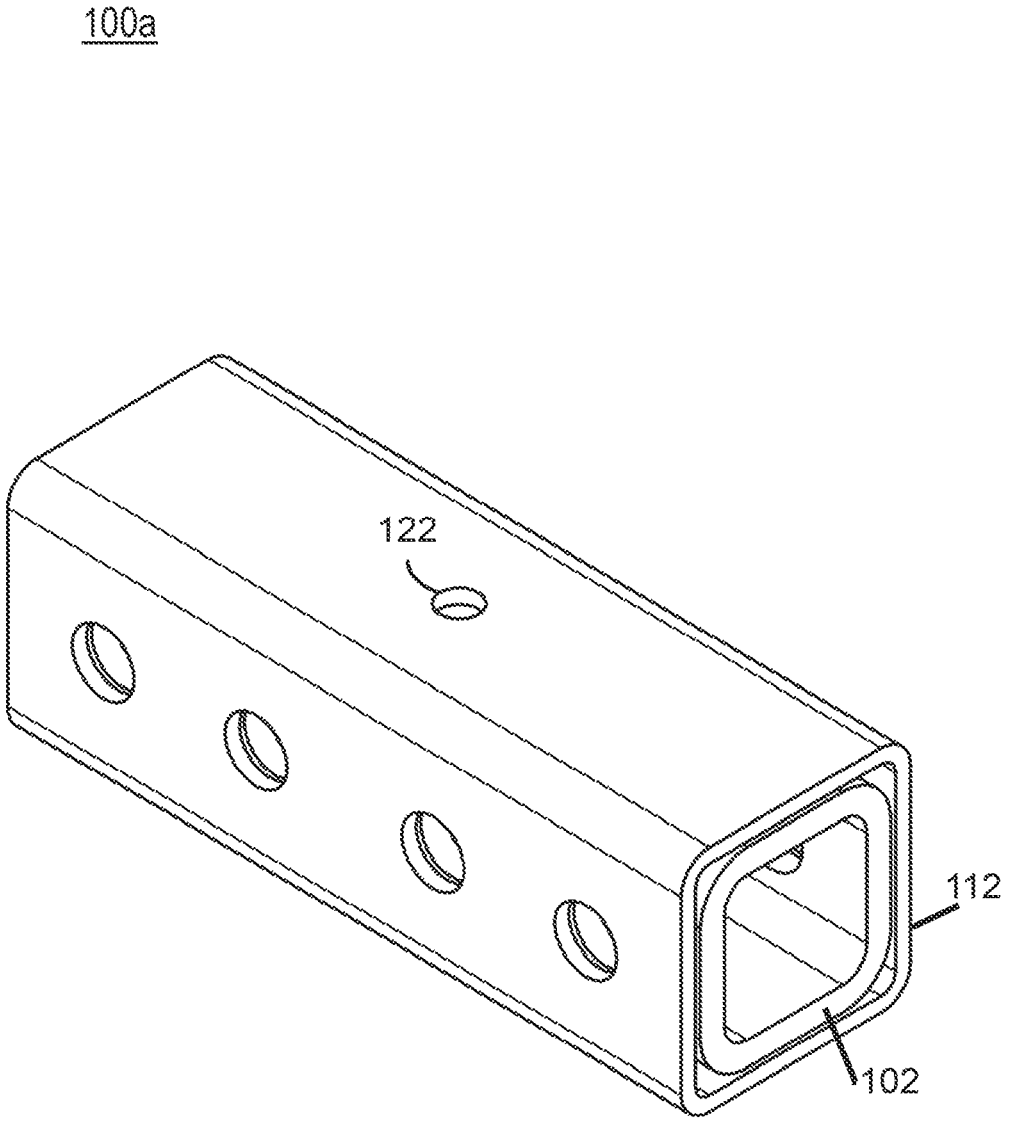
FIG. 2 illustrates a perspective view of a coupler configured to receive four bolts, in accordance with one or more embodiments of the present disclosure.

Referring now to FIG. 2, a coupler 100*a* is described, in accordance with one or more embodiments of the present disclosure. The coupler 100*a* may be similar to the coupler 100, except that the coupler 100*a* may include additional pairs of through holes for receiving additional bolts. Although the coupler 100 has been described as receiving two bolts, this is not intended to be limiting. In this regard, the coupler 100*a* may be configured to receive more than two bolts. For example, the square tube 102 may include the pair of through holes 108, 110. The square tube may additionally include a third and fourth pair of through holes. Similarly, the square tube 112 may include the pair of through holes 118, 120 and additionally include a third and fourth pair of through holes. The third pairs of through holes of the square tube 102 and the square tube 112 may be aligned for receiving a third bolt. Similarly, the fourth pairs of through holes of the square tube 102 and the square tube 112 may be aligned for receiving a fourth bolt. The use of additional bolts may improve the strength of the connection between the coupler and the components of the helical foundation system and/or reduce the strength requirement of the individual bolts (e.g., due to sharing the shearing load with additional bolts). However, the ability to receive additional bolts may come with a fabrication cost for the additional bolts, together with longer square tubes.

Figure 3:
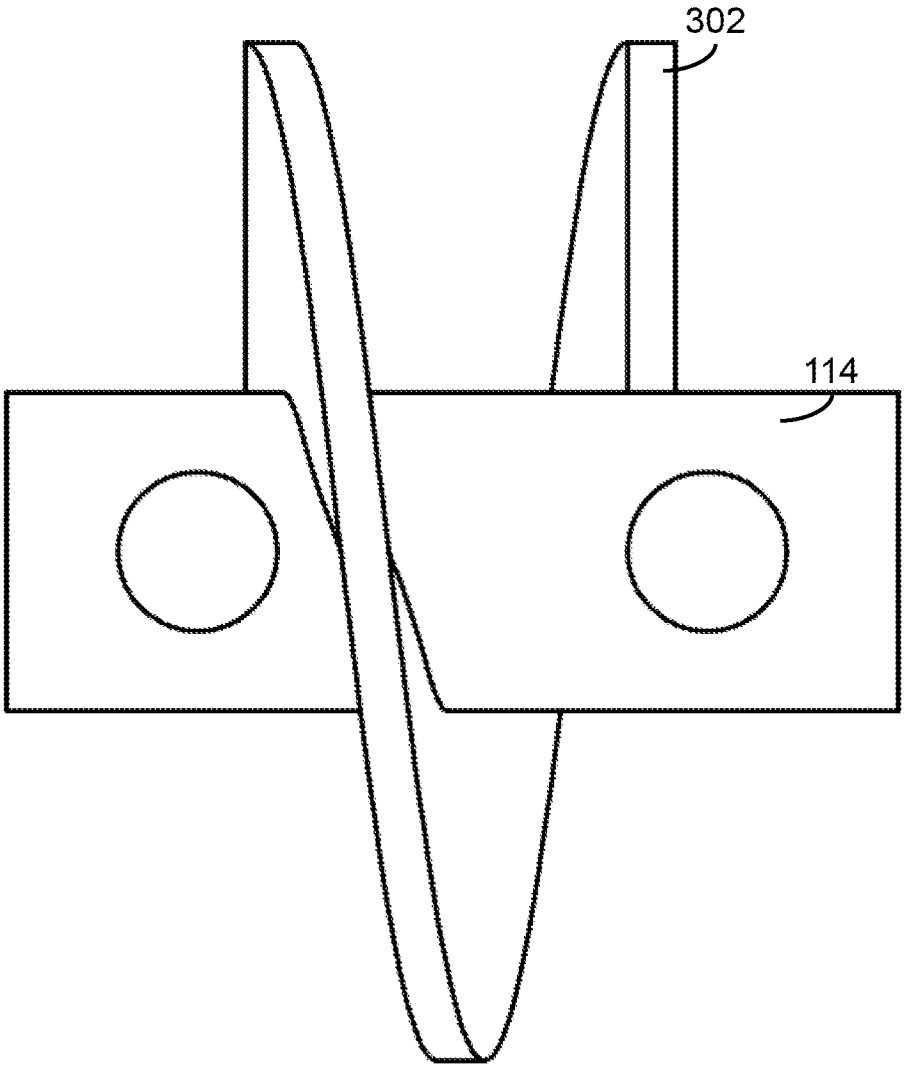
FIG. 3 illustrates a plan view of a coupler including a helix plate, in accordance with one or more embodiments of the present disclosure.

Referring now to FIG. 3, a coupler 100*b* is described, in accordance with one or more embodiments of the present disclosure. The coupler 100*b* may be similar to the coupler 100, except that the coupler 100*b* may include a helix plate 302. It is contemplated that the coupler 100*b*, may include additional components other than previously described above. For example, the square tube 112 may include a helix plate 302 affixed to the wall 114. The helix plate may have a corkscrew-like (helix) shape. The helix plate 302 may be configured so a clockwise (CW) rotation of the shaft and plate advances the pile deeper into the ground. However, the helix plate 302 can be reversed/mirrored and then rotated in the counterclockwise (CCW) direction to advance the pile. The cut style of the helix plate 302 may include any style known in the art, such as, but not limited to, an H-style cut, a V-style cut, or any cut in conformance with ICC Evaluation Service standard AC358. Similarly, the helix plate 302 may include a diameter (varying or constant), leading edge, helix angle, pitch, or thickness according to any helix plate known in the art. In some embodiments, the helix plate is be configured to fit between bolts of the coupler 100*b* or between a bolt of the coupler 100*b* and an end of the coupler 100*b*. The ability to attach a helix plate to the coupler 100*b* may provide for improved supply chain considerations, by potentially reducing the required inventory of extensions with welded helix plates. Furthermore, the helix plate 302 may assist the lead section when a helical pile (including the coupler 100*b*) is driven into the ground. Furthermore, the coupler 100*b* may include multiple helices along the same axis (e.g., a double helix, not depicted).

Figure 4:
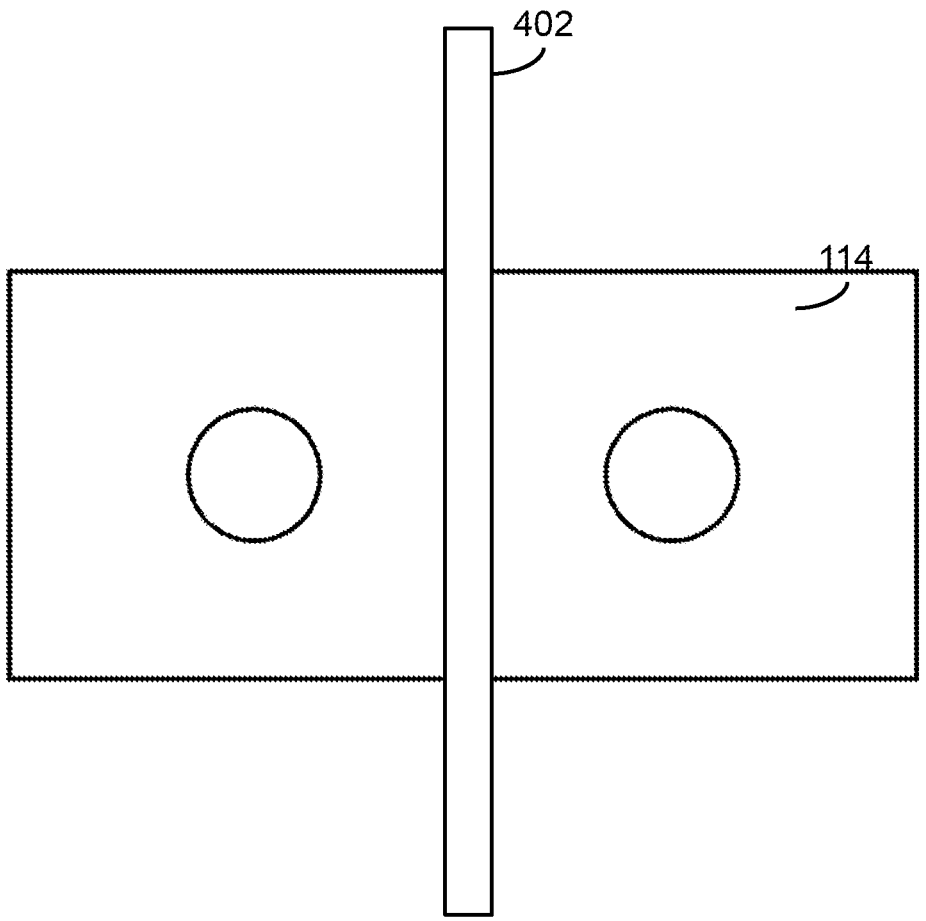
FIG. 4 illustrates a plan view of a coupler including a soil displacement plate, in accordance with one or more embodiments of the present disclosure.

Referring now to FIG. 4, a coupler 100*c* is described, in accordance with one or more embodiments of the present disclosure. The coupler 100*c* may be similar to the coupler 100, except that the coupler 100*c* may include a soil displacement plate 402. The soil displacement plate 402 may be welded to the square of the coupler 100*c*. The soil displacement plate 402 may displace surrounding soil when a helical pile (including the coupler 100*c*) is driven into the ground. The hole may then be filled with grout or other suitable material, for securing the helical pile. The square tube 112 may include the soil displacement plate 402 affixed to the square tube 114. The soil displacement plate 402 may include any soil displacement plate may include any radius and thickness of soil displacement plates known in the art.

Figure 5:
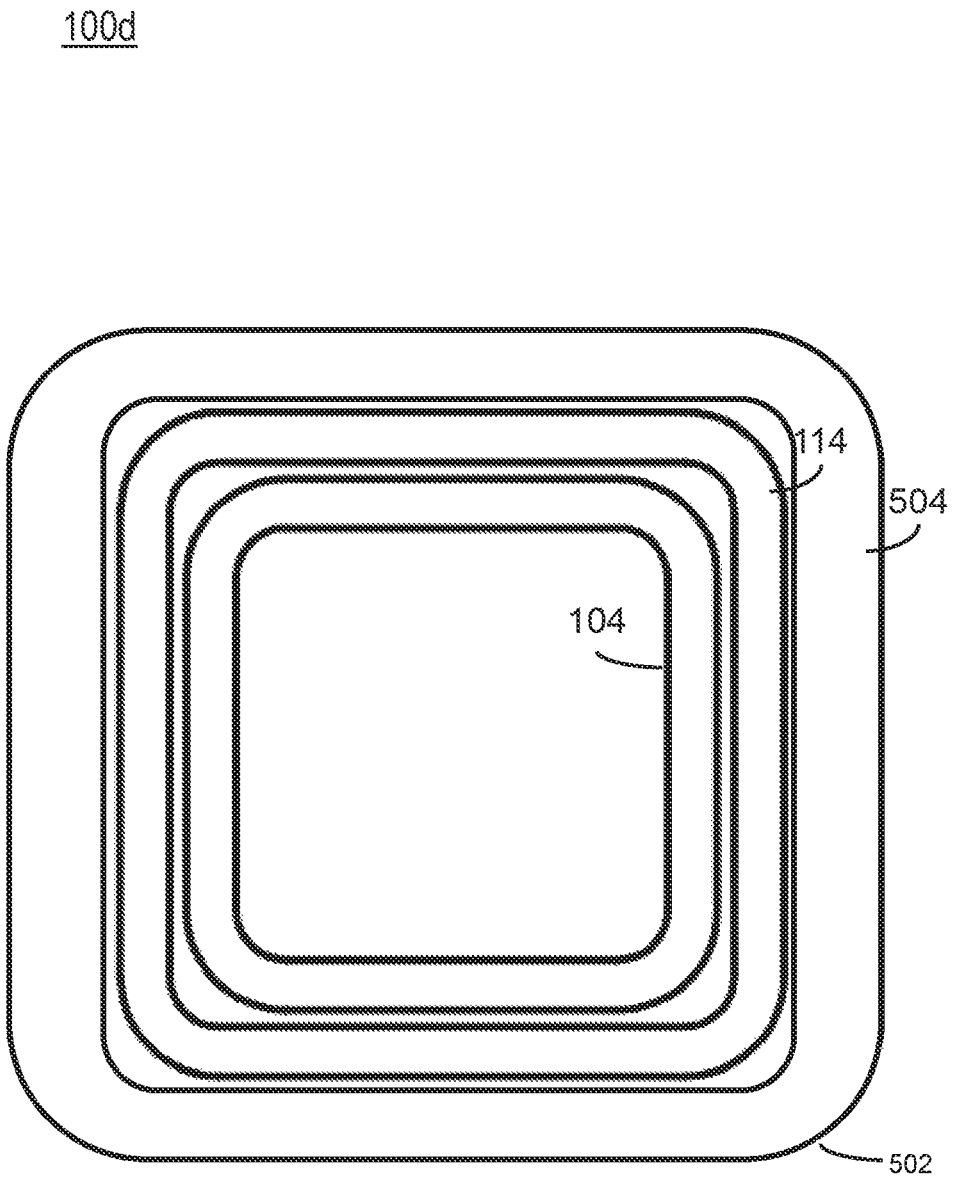
FIG. 5 illustrates a plan view of a coupler including three square tube, in accordance with one or more embodiments of the present disclosure.
Figure 6A:
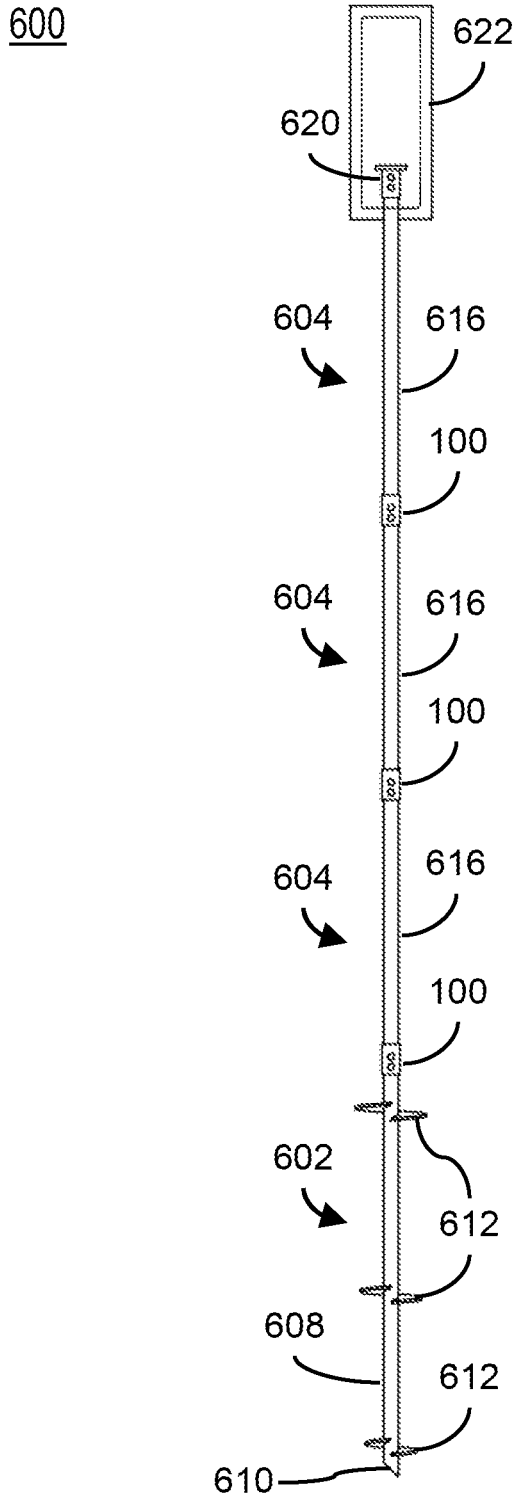
FIG. 6A illustrates a plan view of a helical pile system, in accordance with one or more embodiments of the present disclosure.
Figure 6B:
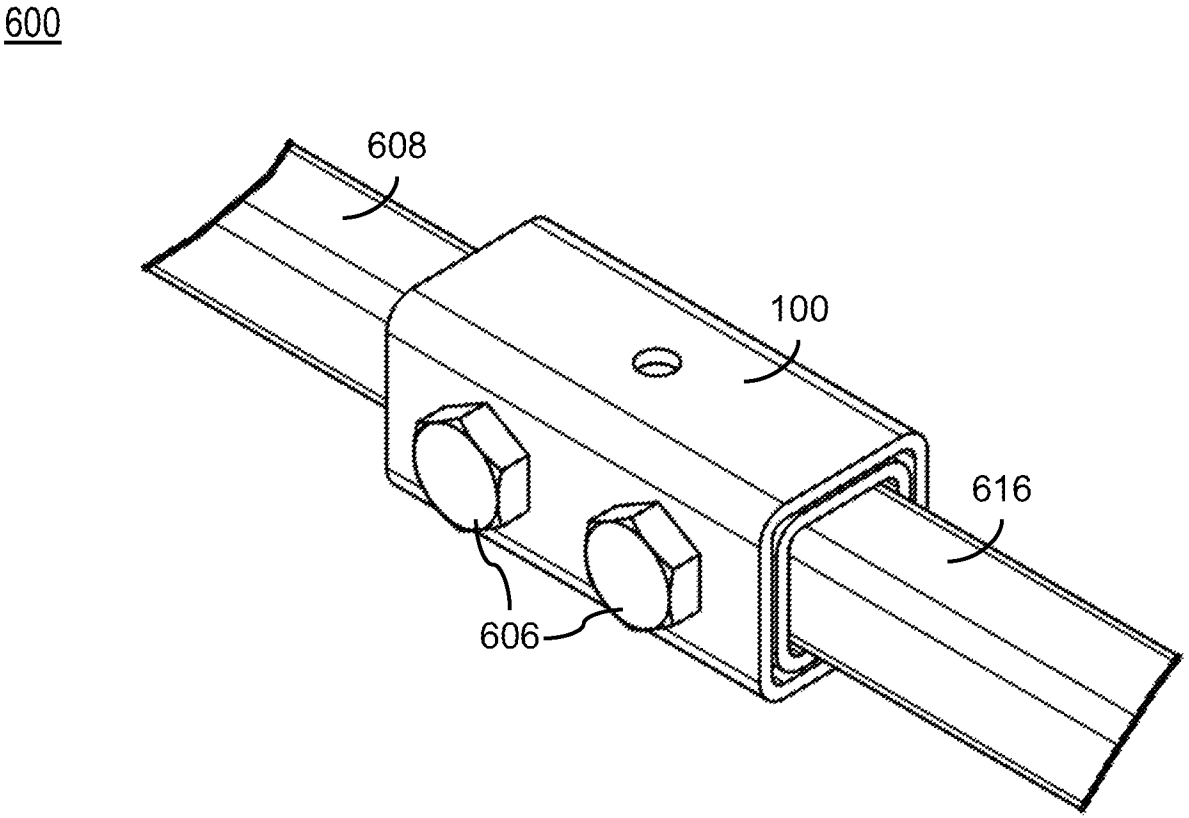
FIG. 6B illustrates a partial perspective view of a helical pile system, in accordance with one or more embodiments of the present disclosure.
Figure 6C:
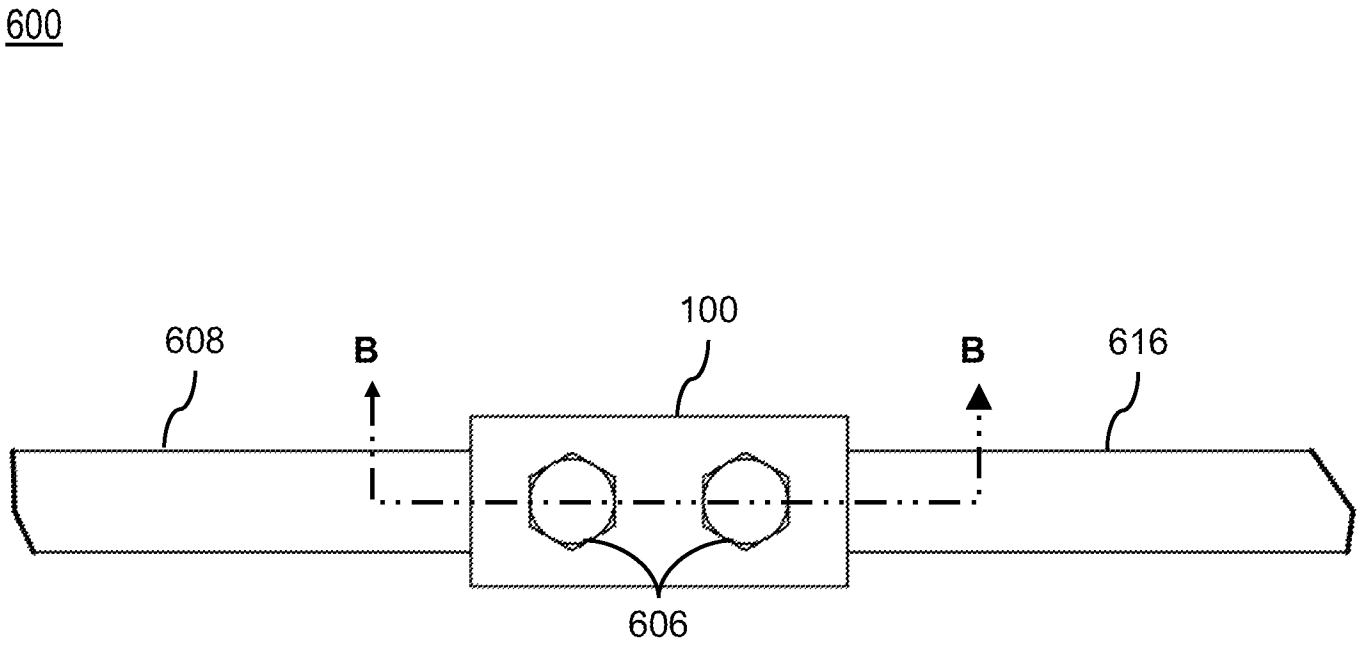
FIG. 6C illustrates a partial plan view of a helical pile system, in accordance with one or more embodiments of the present disclosure.
Figure 6D:
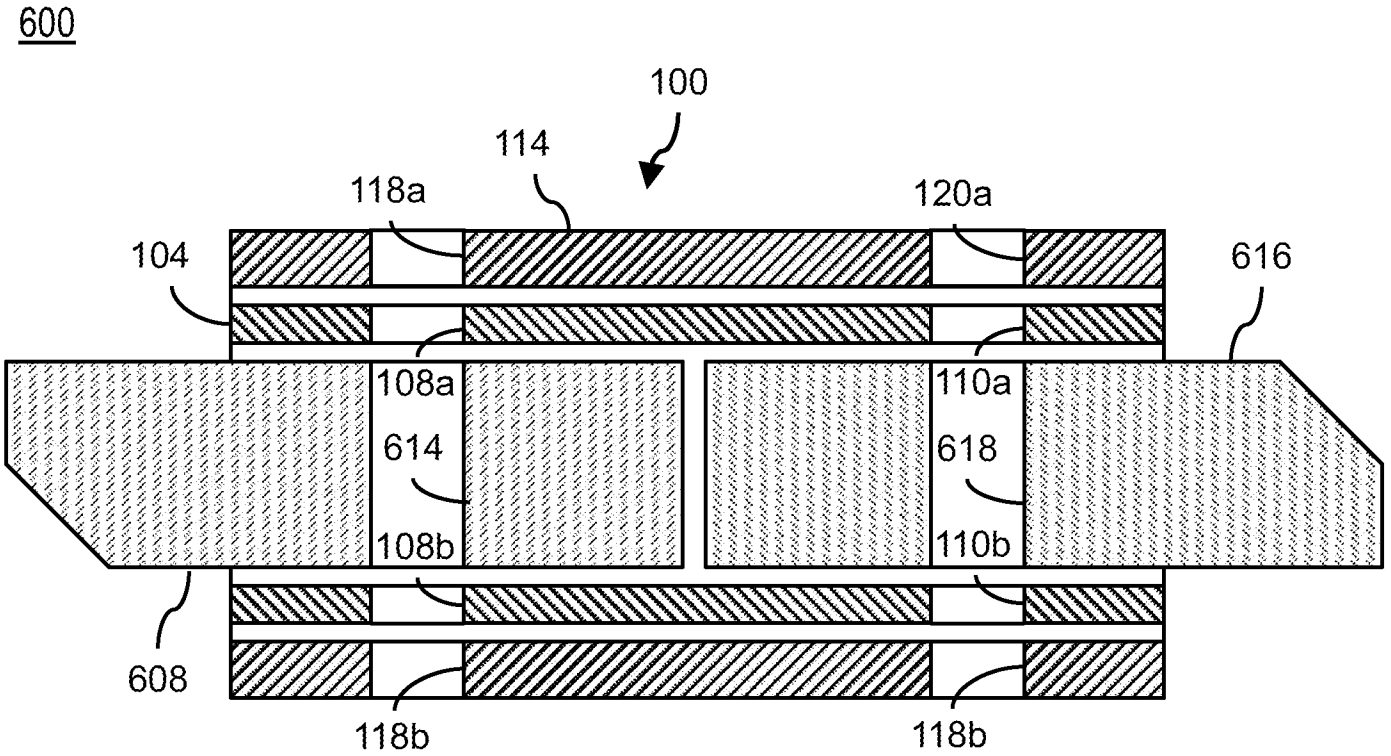
FIG. 6D illustrates a cross-section view B of the helical pile system from FIG. 6C without bolts inserted, in accordance with one or more embodiments of the present disclosure.

Referring now to FIG. 5, a coupler 100*d* is described, in accordance with one or more embodiments of the present disclosure. The coupler 100*d* may be similar to the coupler 100, except that the coupler 100*d* may include additional square tubes. Although the coupler 100 has been described as including a square tube 102 and a square tube 112, this is not intended as a limitation on the present disclosure. The number of square tubes may be selected to provide both a desired fitment and torsional capacity for a select square bar stock using standard gauge tubing. The coupler may include three, four, or more square tubes. For example, the coupler 100*d* includes the square tube 102, the square tube 112, and a square tube 502. The square tube 502 includes a wall 504 defining an interior recess. The interior recess may extend through the square tube. The wall 504 may include an inner width such that the interior recess may receive the receiving the square tube 112 (e.g., by a clearance fit). The square tube may also be affixed to the square tube 112 by a permanent joint. Similar to the square tubes 102, 112, the wall 504 may also define two or more pairs of through holes (not depicted). A first pair of the through holes may be aligned with the pair of through holes 108 and the pair of through holes 118. In this regard, the bolt may be received. A second pair of the through holes may be aligned with the pair of through holes 110 and the pair of through holes 120. In this regard, the bolt may be received. As may be understood, the two pairs of through holes defined by the wall 504 is not intended to be limiting.

Referring now to FIGS. 6A-6D, the helical pile system 600 is described, in accordance with one or more embodiments of the present disclosure. The embodiments and the enabling technology described previously with regards to the coupler 100 (and similarly the couplers 100*a*-100*d*), should be interpreted to extend to the helical pile system 600. The helical pile system 600 may include a lead section 602, one or more of the couplers 100, one or more extension sections 604, and one or more fasteners 606. The helical pile system 600 may also include a termination bracket 620 and a concrete footing 622.

The lead section 602 may include a square bar stock 608. The square bar stock 608 may include a tip 610. The tip 610 may include any tip known in the art, such as but not limited to, a 45-degree cut tip, a bevel-cut tip, or a spiral cut tip. The lead section 602 may also include multiple helix plates 612 affixed to the square bar stock 608 by a permanent joint (e.g., a weld). The square bar stock 608 may include a width and a corner radius, as previously described herein in reference in relation to the interior recess 106. In this regard, the square bar stock 608 may be received within a portion of the coupler 100. The square bar stock 608 may also define a through hole 614 (see FIG. 6D). When the square bar stock 608 is received within the portion of the coupler 100, the through hole 614 may be aligned with the through holes 108, 118, by which the fastener 606 may be inserted.

The extension sections 604 may include a square bar stock 616. Although not depicted, the extension sections 604 may include one or more helix plates or soil displacement plates affixed to the square bar stock 616. The square bar stock 616 may also include a width and a corner radius, as previously described herein in reference in relation to the interior recess 106. The square bar stock 616 may be received within a portion of the coupler 100. The square bar stock 616 may define a through hole 618. When the square bar stock 616 is received within the portion of the coupler 100, the through hole 618 may be aligned with the through holes 110, 120, by which the fastener 606 may be inserted. Thus, the extension section 604 may be coupled to the lead section 602 by the coupler 100. Similarly, two extension sections 604 may be coupled by the coupler 100. Thus, a shaft may be formed by the lead section 602 and one or more of the extension sections 604. The shaft may transfer tensile or compressive loading to the surrounding ground (not depicted).

In some embodiments, faces of the square bar stock (e.g., square bar stock 608, 616) may be in direct contact inside of the coupler 100. Advantageously, the coupler(s) 100 may experience minimal loading when the helical pile system 600 undergoes tensile or compressive loading, due to the contact between the square bar stock. Alternatively, the faces may not be in contact. In this regard, the loads may be transferred between the square bar stock by the coupler 100. However, this may place the coupling bolts in double shear.

In some embodiments, the helical pile system 600 may further include a termination bracket 620. The termination bracket 620 may be affixed (e.g., by a weld or a bolt) to the final extension of the helical pile system 600. In some embodiments, there is no positive connection between the termination bracket 620 and the final extension, such as in a compression loading application. The helical pile system 600 may further include a concrete footing 622. The termination bracket 620 may be embedded in the concrete footing 622.

During installation of the helical pile system 600 into the ground, a drive head (not depicted) may first be coupled to the lead 602. The drive head may then rotate (e.g., by hand-held or powered equipment) the lead 602 to drive the lead until the drive head is nearing the surface of the ground. The drive head may then be disconnected from the lead 602. The coupler 100 may then be coupled to the lead section 602. The extension section 604 may then be coupled to the coupler 100. The drive head may then be connected to the extension section 604 and engaged until the drive head is nearing the surface of the ground. During such driving, torque may be transferred from the extension section 604 to the lead section 602 by a socketing action of the coupler 100. Upon nearing the ground, the drive section may be disconnected and additional couplers and extensions may be added until the helical pile system 600 has reached a desired depth. The termination bracket 620 may then be coupled to the final extension. The concrete footing 622 may then be poured.

As may be understood, the helical pile system 600 may include a number of tension and/or compression applications. Depending upon the application, tensile or compressive loads may be transferred from or to the lead section 602 by way of the extension sections 604. For example, the helical pile system 600 may be a pier loaded in axial compression. By way of another example, the helical pile system 600 may be an anchor loaded in axial tension. For instance, the anchor may be a helical tieback installed at an angle relative to the ground or a soil nail. In this regard, the application of the helical pile system 600 is not intended to be limiting. Furthermore, the lead section 602 and the extension sections 604 may include a number of lengths, such as, but not limited to, 5 feet, 7 feet, 10 feet, 20 feet, a number therebetween, or a greater length depending upon the application and/or the installation technique.

Figure 7A:
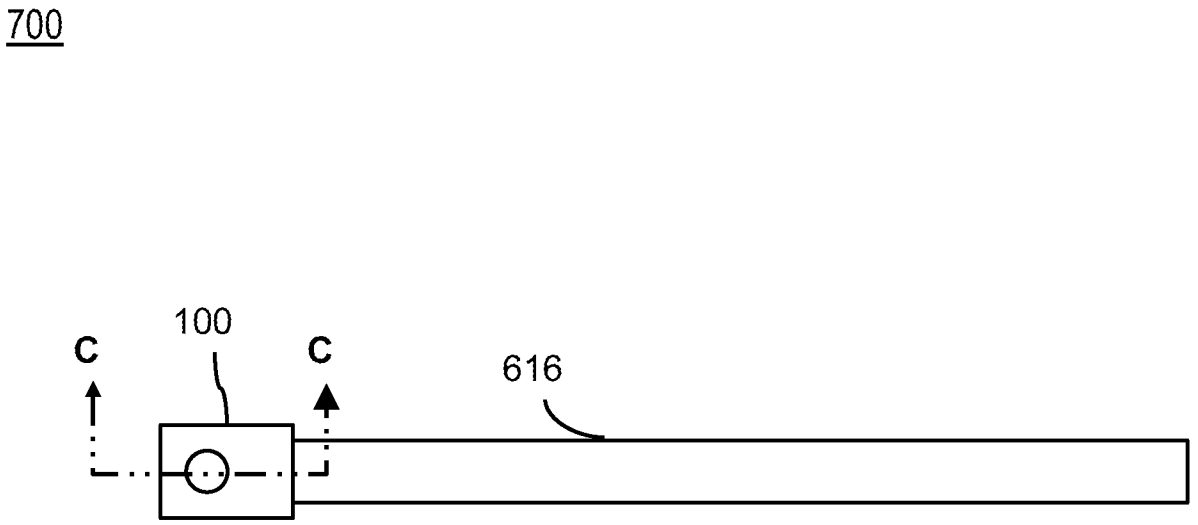
FIG. 7A illustrates a plan view of an extension of a helical pile system with an integrated coupler, in accordance with one or more embodiments of the present disclosure.
Figure 7B:
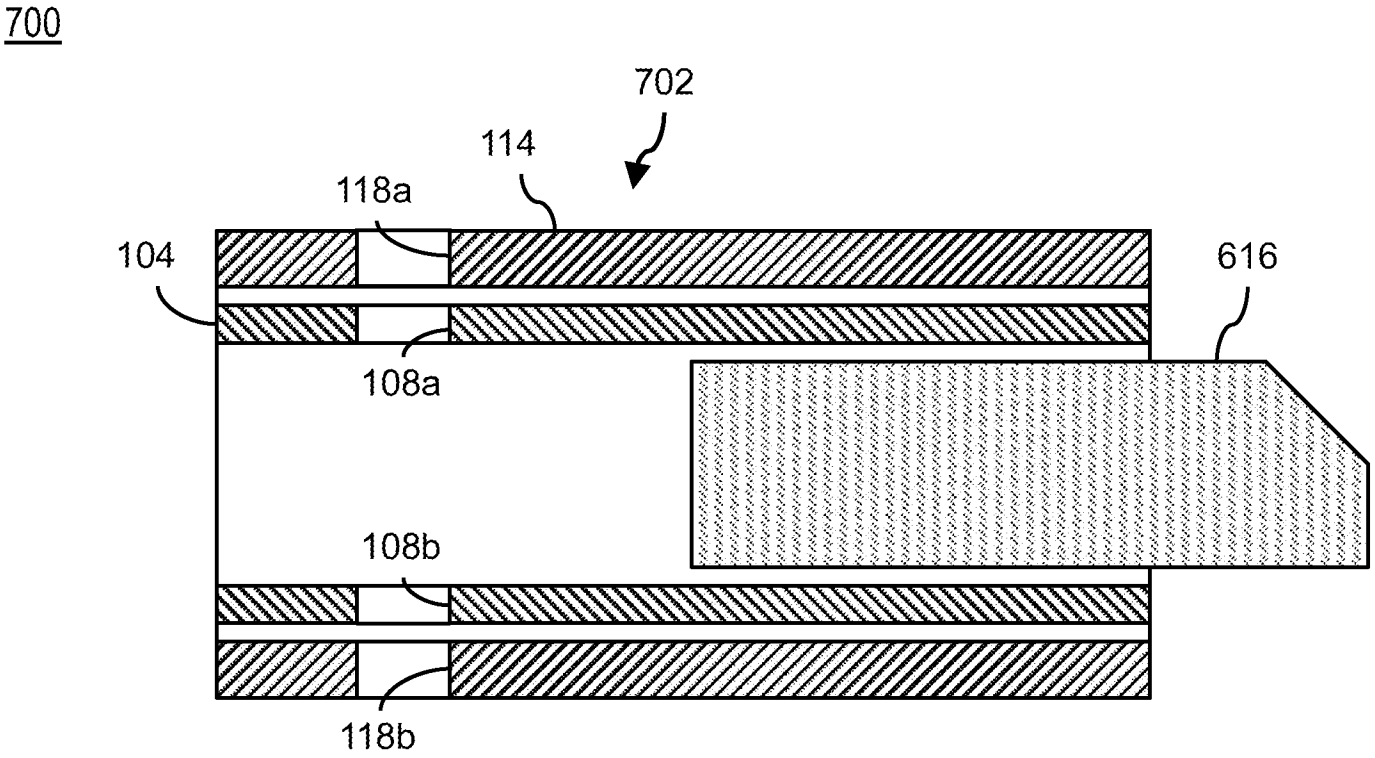
FIG. 7B illustrates a cross-section view C of the extension of a helical pile system with the integrated coupler from FIG. 7A, in accordance with one or more embodiments of the present disclosure.

Referring now to FIGS. 7A-7B, an extension section 700 for a helical pile system is described, in accordance with one or more embodiments of the present disclosure. The extension section 700 may be similar to the square bar stock 616, with the exception that the extension section 700 does not need a through hole by which to be affixed to a coupler 702. In some embodiments, the coupler 702 is integrated with the square bar stock 616. The coupler 702 may be similar to the coupler 100. In this regard, the coupler 702 may include the square tube 102 received within the interior recess of the square tube 112. The square bar stock 616 may be received within a portion (e.g., around halfway) of the interior recess 106. The coupler 702 may further be welded to the square bar stock 616. By welding the coupler 702 to the square bar stock 616, a number of through holes required to assemble a helical pile may be reduced by a factor of two (compare for example, FIGS. 6D and 6B). In some embodiments, the weld is an edge joint weld between the wall 104 and the square bar stock 616. As may be understood, the walls of the coupler may be plug welded prior to welding the coupler 702 to the bar stock 616, for improving in an ease of manufacturing. Alternatively, the walls of the coupler 702 and the bar stock 616 may be welded simultaneously.

The coupler 702 may also be configured to attach to the one or more of the lead section 602 or a second of the extension sections 700. In this regard, the remaining portion of the interior recess 106 may include and/or be aligned with the pairs of through holes 108, 118. The coupler may thus be configured to receive and couple to bar stock of the lead section 602 or a second extension.

Referring generally again to FIGS. 1A-7B.

Although the coupler 100 has been described in regards to a helical foundation system for a building foundation or as a tieback, this is not intended as a limitation on the present disclosure. In this regard, the coupler 100 may be configured for coupling with a variety of components.

Although the square tubes 102, 112 are depicted as being a substantially similar length, this is not intended as a limitation on the present disclosure. It is contemplated that the square tube 102 may include a length greater than the square tube 112. Similarly, the square tube 112 may include a length greater than the square tube 102.

In some embodiments, the square tube 102 may be used as the helical pile shaft material in addition to acting as a coupler. For example, a solid bar may be used as the shorter internal coupler (not depicted). One or more built-up square tubes may then be used as a longer external coupler, effectively performing as the shaft material. By way of another example, solid bar and built-up tubing could be alternated as the shaft material for all or partial lengths of the pile. In this regard, the coupler again is performing as longer shaft material. The same built-up inner and outer tubing could be used as lead sections with welded helix plates. Such configurations described may provide improved flexibility in tip detail by using a tube laser.

Although the coupler 100 has been depicted as including square tubes which are substantially a similar length, this is not intended as a limitation on the present disclosure. For example, the outer square tube may be a length which is greater than or less than the inner square tube. In this regard, the coupler may be configured to receive a first component of the support system with a first outer diameter by way of the outer square tubing and may be configured to receive a second component of the support system with a second outer diameter by way of the inner square tube, where the first outer diameter is larger than the second outer diameter. In this regard, the coupler may be used to step-down or step-up helical pile shaft widths. The ability to control the inner dimension of the coupler may be advantageous where components of the support system have varying widths or diameters.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include changes.

We claim:

1. A coupler comprising:

a first square tube including a first wall defining a first interior recess, a first pair of through holes, and a second pair of through holes, wherein the first interior recess extends through the first square tube, wherein the first interior recess is of a first inner width for receiving a square bar stock of a helical pile system;

a second square tube including a second wall defining a second interior recess, a third pair of through holes, and a fourth pair of through holes, wherein the second interior recess extends through the second square tube, wherein the second interior recess is of a second inner width for receiving the first square tube, the first square tube and the second square tube are a substantially similar length;

wherein the first square tube is received within the second interior recess and is affixed to the second square tube by a plug weld between the first square tube and the second square tube, the plug weld is located at or near a midpoint of a length of the first square tube and the second square tube, wherein the first pair of through holes and the third pair of through holes are aligned for receiving a first bolt; wherein the second pair of through holes and the fourth pair of through holes are aligned for receiving a second bolt, wherein the first pair of through holes and the second pair of through holes are disposed on a first face and a second face opposite to the first face, wherein the plug weld is on a face adjacent to the first face and the second face.

2. The coupler of claim 1, wherein the first wall includes corners with a first radius, wherein the second wall includes corners with a second radius.

3. The coupler of claim 2, wherein the first square tube and the second square tube comprise standard gauge square tubing which have not undergone an upset forging process.

4. The coupler of claim 1, wherein the first square tube includes a first end and a second end, wherein the second tube includes a third end and a fourth end, wherein the first end is aligned with the third end, wherein the second end is aligned with the fourth end.

5. The coupler of claim 1, wherein the first wall further defines a fifth pair of through holes and a sixth pair of through holes, wherein the second wall further defines a seventh pair of through holes and an eight pair of through holes, wherein the fifth pair of through holes are aligned with the seventh pair of through holes for receiving a third bolt, wherein the sixth pair of through holes are aligned with the eight pair of through holes for receiving a fourth bolt.

6. The coupler of claim 1, wherein the second square tube includes one of a helix plate or a soil displacement plate.

7. The coupler of claim 1, further comprising:

a third square tube including a third wall defining a third interior recess, a fifth pair of through holes, and a sixth pair of through holes, wherein the third interior recess extends through the third square tube, wherein the third interior recess is of a third inner width for receiving the second square tube;

wherein the second square tube is received within the third interior recess and is affixed to the second square tube by a second permanent joint; wherein the first pair of through holes, the third pair of through holes, and the fifth pair of through holes are aligned for receiving the first bolt; wherein the second pair of through holes, the fourth pair of through holes, and the sixth pair of through holes are aligned for receiving the second bolt.

8. A helical pile system comprising:

a lead section including a first square bar stock and a plurality of helix plates affixed to the first square bar stock;

an extension section including a second square bar stock; and a coupler including:

a first square tube including a first wall defining a first interior recess, a first pair of through holes, and a second pair of through holes, wherein the first interior recess extends through the first square tube, wherein the first interior recess is of a first inner width for receiving the first square bar stock and the second square bar stock; and a second square tube including a second wall defining a second interior recess, a third pair of through holes, and a fourth pair of through holes, wherein the second interior recess extends through the second square tube, wherein the second interior recess is of a second inner width for receiving the first square tube, the first square tube and the second square tube are a substantially similar length;

wherein the first square tube is received within the second interior recess and is affixed to the second square tube by a plug weld between the first square tube and the second square tube, the plug weld is located at or near a midpoint of a length of the first square tube and the second square tube, wherein the first pair of through holes and the third pair of through holes are aligned for receiving a first bolt; wherein the second pair of through holes and the fourth pair of through holes are aligned for receiving a second bolt; wherein the first square bar stock defines a first through hole; wherein the first bar stock is received within a first portion of the first interior recess and is coupled to the coupler by the first bolt, the first pair of through holes, the third pair of through holes, and the first through hole; wherein the second square bar stock defines a second through hole; wherein the second bar stock is received within a second portion of the first interior recess and is coupled to the coupler by the second bolt, the second pair of through holes, the fourth pair of through holes, and the second through hole, wherein the first pair of through holes and the second pair of through holes are disposed on a first face and a second face opposite to the first face, wherein the plug weld is on a face adjacent to the first face and the second face.

9. The helical pile system of claim 8, further comprising a second coupler and a second extension section, wherein the second extension section is coupled to the extension section by the second coupler.

10. The helical pile system of claim 9, wherein the second tube includes a soil displacement plate.

11. The helical pile system of claim 10, wherein the second coupler includes a second soil displacement plate.

12. The helical pile system of claim 11, further comprising a grout material disposed between the soil displacement plate and the second soil displacement plate.

13. The helical pile system of claim 8, wherein the helical pile system is one of a pier, an anchor, a helical tieback, or helical soil nail.

14. The helical pile system of claim 8, wherein the extension section further includes a second plurality of helix plates.

15. An extension section, comprising:

a square bar stock; and a coupler including:

a first square tube including a first wall defining a first interior recess and a first pair of through holes, wherein the first interior recess extends through the first square tube, wherein the first interior recess is of a first inner width for receiving the square bar stock; and a second square tube including a second wall defining a second interior recess and a second pair of through holes, wherein the second interior recess extends through the second square tube, wherein the second interior recess is of a second inner width for receiving the first square tube, the first square tube and the second square tube are a substantially similar length;

wherein the first square tube is received within the second interior recess and affixed to the second square tube by a plug weld between the first square tube and the second square tube, the plug weld is located at or near a midpoint of a length of the first square tube and the second square tube, wherein the first pair of through holes and the second pair of through holes are aligned for receiving a bolt; wherein the square bar stock is received within a first portion of the first interior recess and is affixed to the coupler by a second permanent joint; wherein a second portion of the first interior recess is aligned with the first pair of through holes and the second pair of through holes by which the coupler is configured to receive and couple to a second square bar stock, wherein the first pair of through holes and the second pair of through holes are disposed on a first face and a second face opposite to the first face, wherein the plug weld is on a face adjacent to the first face and the second face.

* * * * *